United States Patent [19]

Kimura et al.

[11] Patent Number: 4,798,532

[45] Date of Patent: Jan. 17, 1989

[54] FLASH SMELTING FURNACE

[75] Inventors: Takayoshi Kimura; Yasuo Ojima; Yoshiaki Mori, all of Niihama, Japan

[73] Assignee: Sumitomo Metal Mining Company Limited, Tokyo, Japan

[21] Appl. No.: 113,400

[22] Filed: Oct. 26, 1987

Related U.S. Application Data

[63] Continuation of Ser. No. 900,698, Aug. 27, 1986, abandoned.

[30] Foreign Application Priority Data

Sep. 5, 1985 [JP] Japan ..... 60-197433

[51] Int. Cl.[4] ..... F26B 3/00; F27B 19/02

[52] U.S. Cl. ..... 432/210; 266/212; 266/227; 110/238

[58] Field of Search ..... 432/161, 197, 210; 110/238; 266/205, 212, 227, 232, 242

[56] References Cited

U.S. PATENT DOCUMENTS

| | | | |
|---|---|---|---|
| 3,353,807 | 11/1967 | Sixel et al. | 266/212 |
| 3,527,449 | 9/1970 | Warner | 266/232 |
| 3,901,489 | 8/1975 | Suzuki et al. | 266/227 |
| 3,975,228 | 8/1976 | Yasunaga et al. | 110/238 |
| 4,200,265 | 4/1980 | Berndt et al. | 266/212 |
| 4,226,406 | 10/1980 | Frolov et al. | 266/227 |
| 4,401,295 | 8/1983 | Yoshida | 266/227 |
| 4,457,777 | 7/1984 | MacGregor et al. | 266/212 |

*Primary Examiner*—Henry C. Yuen

*Attorney, Agent, or Firm*—Watson, Cole, Grindle & Watson

[57] ABSTRACT

A flash smelting furnace which comprises a reaction shaft, a concentrate combustion device disposed at the top of the furnace shaft, a settler disposed with one end thereof connected to the lower part of the reaction shaft, an uptake disposed as connected to the other end of the settler and at least one lance pipe extending through the ceiling of the settler between the reaction shaft and the uptake and adapted to blow at least powdery raw materials and a reaction gas into the melt inside the settler.

2 Claims, 1 Drawing Sheet

PRIOR ART

FLASH SMELTING FURNACE

This application is a continuation of application Ser. No. 900,698, filed Aug. 27, 1986, now abandoned.

BACKGROUND OF THE INVENTION

1. FIELD OF THE INVENTION

This invention relates to improvements in and concerning a flash smelting furnace for producing matte from a copper or nickel sulfide ore as a smelting intermediate for the corresponding metal.

2. DESCRIPTION OF THE PRIOR ART

The flash smelting furnace which uses a sulfide concentrate as a raw material and which is popularly called a "flash furnace" possesses many advantages as compared with the other smelting furnaces and, on the other hand, suffers from many disadvantages. By way of illustrating, the conventional flash furnace for copper will be described with reference to FIG. 2.

In a flash furnace 1, a powdered concentrate 2 and preheated air 3 are jointly blown into a reaction shaft 5 of the furnace through a concentrate burner 4 at the top of the furnace. Inside the furnace shaft 5, sulfur and iron, which are combustible components of the powdered concentrate 2, react with the hot air 3 and melt themselves. The resulting melt is stored in a settler 6. In the settler 6 which is a reservoir for the melt, the melt is divided by differences in specific gravity into a matte 7, which is a mixture of $Cu_2S$ and FeS, and a slag 8, consisting mainly of $2FeO.SiO_2$. The slag 8 is discharged through a slag discharge outlet 9 and introduced into an electric slag melting furnace 10. In the meantime, the matte 7 is withdrawn via a matte discharge outlet 11 in compliance with the demand from a converter which constitutes itself a next step of operation.

Meanwhile, a hot waste gas 12 from the reaction shaft 5 is advanced through the settler 6 and a uptake 13 and cooled in a boiler 14. The slag 8 which has entered the electric slag cleaning furnace 10 is kept heated with the heat generated by the electricity fed in through electrodes 15 and, when necessary, mixed as with lumps of ore introduced into the electric slag cleaning furnace 10, with the result that the copper component is further sedimented to the furnace bottom and only the residual slag containing a copper component is discharged via an outlet 16.

The conventional flash smelting furnace has entailed many drawbacks as indicated below.

(1) Since the auxiliary fuel is used inside the reaction shaft 5 to make up for insufficient calorific supply, an atmosphere of fairly high temperature is formed inside the reaction shaft 5 by the heat of reaction of the concentrate as the raw material and the heat of combustion of the auxiliary fuel. An attempt at increasing the amount of the concentrate to be treated results in a severe wearing of the lining refractory bricks of the reaction shaft 5 by melting, making it necessary to limit the amount of the concentrate to be forwarded through the concentrate burner 4 and treated per unit time to an extent at which the wearance of the bricks by smelting is tolerable. This wearance of the bricks by smelting closely bears on the thermal load of the reaction shaft. The loss is conspicuously heavy when the thermal load exceeds 350,000 $Kcal/m^3.hr$. Thus, the thermal load is desired to be not more than 250,000 $Kcal/m^3.hr$.

An addition to the amount of treatment can be realized by increasing the inside diameter and height of the reaction shaft. Since the reaction shaft consequently has an increased surface area, the heat radiatd is increased and the amount of the auxiliary fuel used in making up for the loss of heat is also increased. Such an addition exclusively to the reaction shaft as described above inevitably exposes the existing flash furnace to considerable difficulties.

As a means of permitting treatment of an increased amount of the concentrate, a method which resorts to an increase in the oxygen content of the preheated air 3 or to an increase in the degree of oxygen enrichment may be conceived. Again in this case, the interior of the reaction shaft 5 suffers formation of an atmosphere of still higher temperature. For the sake of avoiding loss of the lining refractory bricks by melting, the amount of the concentrat to be treated has its own upper limit.

(2) In the concentrate burner 4, the powdery concentrate 2 and the preheated air 3 are blown into the empty space of the reaction shaft 5 and the melt consequently formed falls in drops and separates into the matte and the slag in the settler 6. The waste gas 12 from the flash furnace 1, therefore, contains a large amount of dust. This dust accumulates in the uptake 13, in the part interconnecting the uptake 13 and the boiler 14, and inside the boiler 14 and offers obstacle to the passage of gas.

Since the dust contains valuable metals, it is recovered as in the boiler and the electric static precipitator and returned to the flash furnace 1 as entrained by the concentrate 2 being fed thereto. When the recovered dust which has undergone further oxidation and has been deprived of combustibility is to treated in the concentrate burner 4, the amount of the auxiliary fuel required is increased and the incombustible dust has a high melting point. Thus, the proportion in which the dust is entrained by the waste gas and taken out of the furnace is increased to add to the amount of dust.

(3) An attempt at increasing the amount of the concentrate to be treated in the concentrate burner 4 results in a deviation from the optimum gas flow rate inside the reaction shaft 5. Consequently, the ratio of dust generation described in (2) above is increased. Thus, for the sake of curbing the ratio of dust generation, the amount of the concentrate forwarded through the concentrate burner for treatment has its own upper limit.

(4) The reaction shaft 5 is filled with an oxidative atmosphere. Particularly the low-temperature zone in which the powdery raw material blown in through the concentrate burner 4 has not yet been heated sufficiently to the prescribed level is liable to form magnetite. The magnetite offers various hindrances to the furnace operation. For example, the magnetite increases the viscosity of the slag, impairs the separation of the slag from the matte and brings about an increase in the copper content of the slag. Besides, since the magnetite has a high density, it settles to and accumulates on the hearth, raises the surface of the hearth, and decreases the available volume of the hearth. Further, the magnetite combines itself with other oxide, particulary $Cr_2O_3$, and gives rise to a slag of high viscosity as an intermediate layer between the matte and the slag and interferes with the separation of the matte from the slag. The slag of high viscosity mentioned above possesses a high melting point and a high viscidity and, consequently renders the discharge of the slag through the slag outlet 9 difficult.

SUMMARY OF THE INVENTION

For the solution of the drawbacks suffered by the conventional flash furnace as described above, this invention aims to provide a flash smelting furnace which is capable of increasing the amount of the concentrate to be treated without requiring any increase of size beyond the size of the existing flash smelting furnace.

The other functions and characteristic features of this invention will become apparent from the further disclosure of the invention to be given hereinbelow with reference to the accompanying drawings.

DETAILED DESCRIPTION OF THE INVENTION

To accomplish the object described above, this invention provides a flash smelting furnace comprising a reaction shaft, a concentrate combustion device disposed at the top of the reaction shaft, a settler disposed with one end thereof connected to the lower part of the furnace shaft, and a uptake disposed as connected to the other end of the settler, which flash smelting furnace is characterized by being provided with at least one lance pipe laid through the ceiling of the settler between the furnace shaft and the uptake and adapted to blow at least powdery raw materials and a reaction gas into the melt inside the settler.

Figure 1:
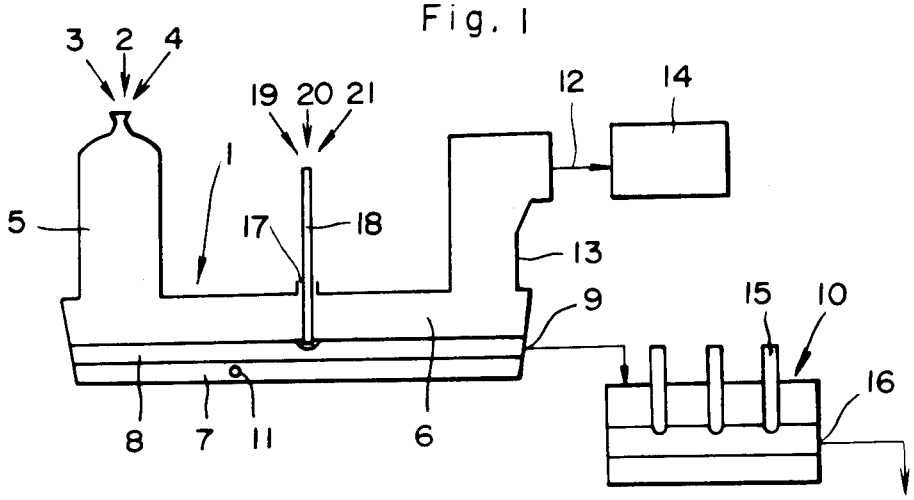
FIG. 1 is an explanatory diagram of a typical flash smelting furnace embodying the present invention.

One working example of this invention will be described below with reference to FIG. 1. As illustrated in FIG. 1, the flash smelting furnace of this invention is identical with the conventional countertype in respect that it is provided with a reaction shaft 5 incorporating therein a concentrate burner 4, a settler 6, and a uptake 13. The settler 6 is provided in the ceiling thereof with a through hole 17 for permitting insertion of a lance pipe. Through this hole 17, a top lance pipe 18 is inserted in such a manner that it will blow the powdery raw material 19 and the gas 20 for reaction and optionally the auxiliary fuel 21 into the melt of the slag 8 or the matte 7 collected inside the settler 6. The number of lance pipes 18 so used may be one or two or more, depending on the amount of the powdery raw material to be supplied through the settler 6. The lance pipe 18 is of a consumable type such that it will be gradually lowered by device 30 as the leading (lower) end thereof is worn out and will eventually be succeeded by a fresh supply. The lance pipe 18 may be otherwise of a non-consumable type such that it will be fixed above the slag 8 to position the leading end of the lance pipe apart from the slag level by 400–500 mm.

In accordance with the flash smelting furnace of this invention, the powdery concentrate 2 supplied to the reaction shaft 5 is melted by the reaction with the gas 3 and the resulting melt is separated by differences in specific gravity into the slag 8 and the matte 7 in the settler 6. The waste gas which arises in the reaction shaft 5 is forwarded through the empty space of the settler 6 and the uptake 13 to the boiler 14.

Figure 1A:
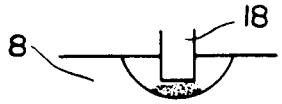
FIG. 1A and FIG. 1B are magnified diagrams of the leading end of a lance pipe shown in FIG. 1.
Figure 1B:
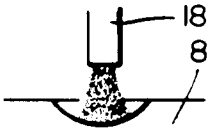
Figure 2:
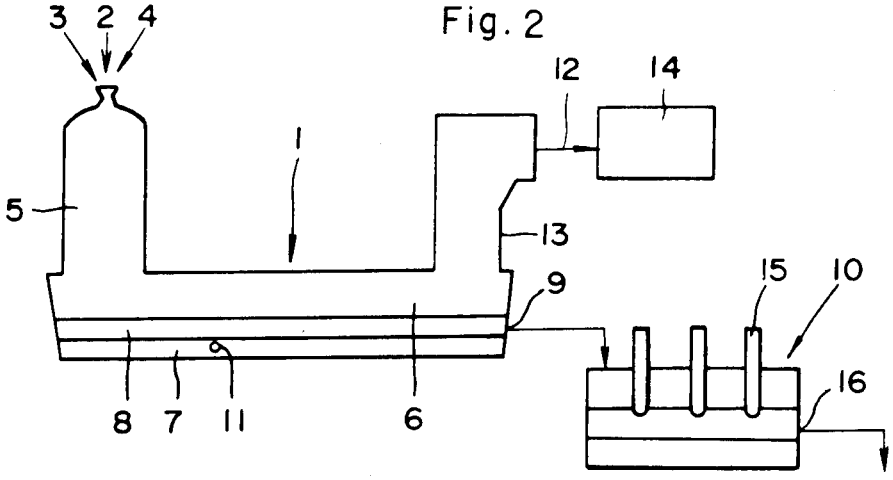
FIG. 2 is an explanatory diagram of the conventional flash smelting furnace.

In the meantime, the top lance pipe 18 inserted through the hole 17 in the ceiling of the settler 6 permits powdery raw materials 19 such as concentrate, recycled dust, copper bearing material, and flux, a reaction gas 20 such as air or oxygen-enriched air, and optionally an auxiliary fuel 21 such as heavy oil or carbon dust coal, coke to be blown into the melt held inside the settler 6. The leading end of the lance pipe 18 is slightly immersed below the surface of the melt so that the forced flow of the powdery raw materials 19, the reaction gas 20, etc., will form a depressed surface on the surface of the melt (as illustrated in FIG. 1A). If the powdery raw materials and reaction gas are blown at a high velocity, the leading end of the lance pipe may be kept apart from the surface of the melt, as shown in FIG. 1B.

The powdery raw materials thus blown in through the leading end of the lance pipe immediately find their way into the melt, react with the melt and dissolve. The waste gas generated herein is discharged through the uptake in conjunction with the waste gas generated in the reaction shaft 5.

The flash smelting furnace of this invention acquires a notably large capacity for smelting the concentrate as compared with the conventional flash furnace because it enables the same amount of concentrate to be forwarded through the concentrate burner and melted in the furnace shaft as in the conventional flash smelting furnace and further enables an additional amount of concentrate to be introduced through the lance pipe and melted. In this case, the form of the reaction which the ore undergoes inside the reaction shaft is not affected by the lance pipe to be used in the settler. The reaction is allowed to proceed under the optimum conditions.

When the waste gas arising in the reaction shaft and containing large amount of dust passes through the empty space inside the settler, it advances across the splash of the melt caused by the forced flow introduced through the lance pipe. Since part of the dust is mechanically caught by the drops of the melt, and the dust content of waste gas emanating from the uptake is proportionately decreased and the dust trouble caused in the uptake, the boiler, and the part interconnecting them is alleviated. Until the magnetite formed by the reaction of the concentrate fed in through the reaction shaft is discharged via the slag hole, the slag containing the phase of slag of large viscosity is vigorously stirred by the concentrate and the reaction gas which are blown in via the lance pipe. Since the magnetite in the slag of large viscosity is not present in equilibrium therein, the greater part of the magnetite is reduced by the fact that the slag is homogenized by the stirring. Besides, the magnetite is further reduced by the reaction:

$$3Fe_3O_4 + FeS = 10FeO + SO_2$$

which is caused by the FeS in the concentrate blown in through the lance pipe. As the result, the loss of copper into the slag is decreased and the difficulty in the discharge of the slag through the slag outlet due to the high viscosity is eliminated.

This invention eliminates the drawbacks suffered by the conventional flash smelting furnace as described above and brings about the following advantages as well.

(1) Since the non-combustible raw materials such as repeat dust which have heretofore been treated through the concentrate burner can be blown in via the lance pipe into the melt, the solubility of the non-combustible raw materials is improved and the ratio of dust generation is lowered and the ratio of consumption of the auxiliary fuel in the concentrate burner is lowered.

(2) The amount of the concentrate advanced for treatment through the concentrate burner can be lowered by introducing additional concentrate via the lance pipe. The volatility of the volatile impurities can be improved because the reaction inside the reaction shaft can be carried out at a temperature higher than in the conventional furnace by using air of higher oxygen content. Thus, the flash smelting furnace of this invention is enabled to treat a concentrate of a higher content of impurities than tolerable in the conventional furnace. Further, the efficiency of the removal of volatile impurities can be expected to be enhanced by feeding a concentrate of a high content of volatile impurities through the concentrate burner and a concentrate of a low content of volatile impurities via the lance pipe.

(3) The copper content in the slag to be discharged through the slag outlet can be further lowered even to the extent of permitting omission of the slag cleaning furnace by blowing a reducing agent via the lance pipe as occasion demands.

While the present invention has been described by means of a specific embodiment, it is to be understood that numerous changes and modifications may be made therein without departing from the spirit and scope of the invention defined in the appended claims.

What is claimed is:

1. In a flash smelting furnace for producing matte from a copper or nickel sulfide ore comprising a reaction shaft, a concentrate combustion device disposed at a top of said reaction shaft, means for supplying oxidizing gas to said top of said reaction shaft, means for supplying powdered copper or nickel sulfide ore concentrate to said top of said reaction shaft, a settler for containing melt formed in said reaction shaft and having opposite first and second ends and a ceiling, said first end of said settler being connected to a lower part of said reaction shaft, and an uptake connected to said second end of said settler, the improvement wherein said flash smelting surface includes at least one consumable lance pipe extending downwardly through the ceiling of said settler between said furnace shaft and said uptake, means for supplying powdery raw material which includes copper or nickel sulfide ore concentrate to each of said lance pipes for discharge against said melt in said settler, means for simultaneously supplying a reaction gas to each of said lance pipes for discharge against said melt in said settler, and means connected to each of said lance pipes to move the associated lance pipe downwardly into said settler as a lower end thereof in said settler is consumed.

2. A flash smelting furnace according to claim 1, including means for simultaneously supplying an auxiliary fuel to each of said lance pipes for discharge against said melt in said settler.

* * * * *